United States Patent [19]

Nimee et al.

[11] Patent Number: 4,852,919

[45] Date of Patent: Aug. 1, 1989

[54] DOOR MAGNET IMPROVEMENT

[75] Inventors: George S. Nimee, Cherry; Andrew Current, Oglesby, both of Ill.

[73] Assignee: Schlage Lock Company, San Francisco, Calif.

[21] Appl. No.: 304,909

[22] Filed: Feb. 2, 1989

Related U.S. Application Data

[63] Continuation of Ser. No. 69,992, Jul. 6, 1987, abandoned.

[51] Int. Cl.[4] ..... E05C 19/16

[52] U.S. Cl. ..... 292/251.5; 292/DIG. 15; 292/DIG. 60; 292/DIG. 53

[58] Field of Search ..... 292/DIG. 15, 251.5, 292/DIG. 72, DIG. 53, 341.18

[56] References Cited

U.S. PATENT DOCUMENTS

| | | | |
|---|---|---|---|
| 1,479,398 | 1/1924 | Ollard | 292/DIG. 72 |
| 2,496,691 | 2/1950 | Berry | 292/251.5 |
| 2,673,377 | 3/1954 | Gaugler | 292/251.5 X |
| 2,801,870 | 8/1957 | Davey | 292/251.5 |
| 3,781,047 | 12/1973 | Surko, Jr. | 292/251.5 |
| 4,669,766 | 6/1987 | Hanchett, Jr. et al. | 292/251.5 |

*Primary Examiner*—Richard E. Moore

*Attorney, Agent, or Firm*—Walter C. Vliet

[57] ABSTRACT

A swivel mounted armature plate for use with an electromagnetic door holder features a spherical socket connection to an adjusting screw which may be secured in any combination of depth and rotation within its operating range.

12 Claims, 1 Drawing Sheet

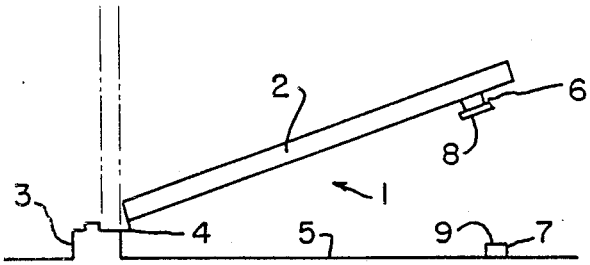
FIG. 1
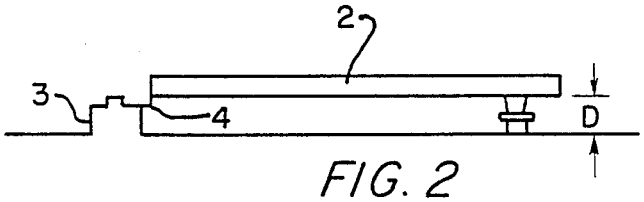
FIG. 2
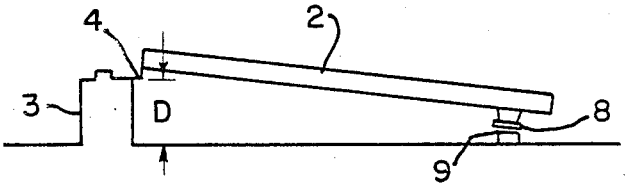
FIG. 3
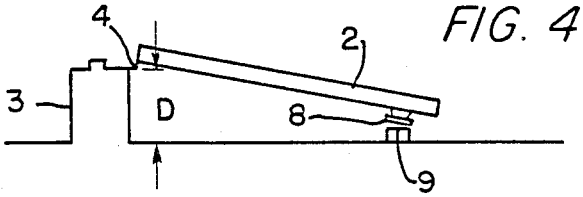
FIG. 4
FIG. 6
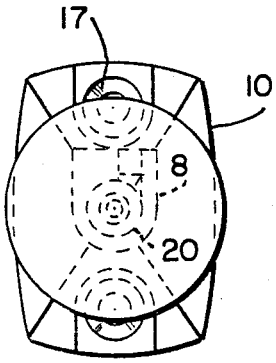
FIG. 5
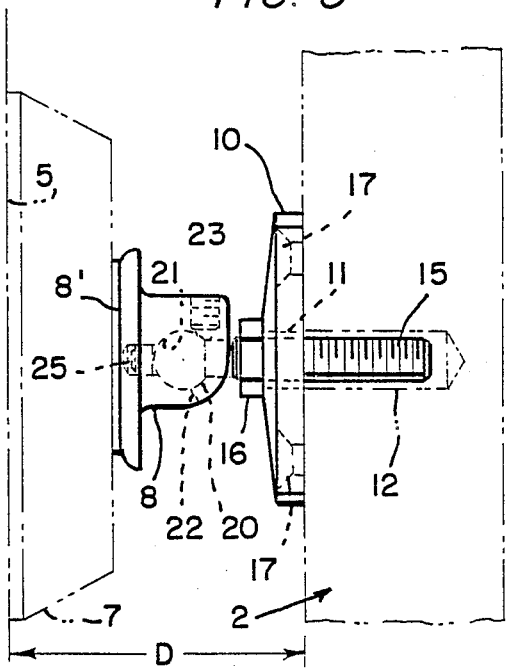
FIG. 7
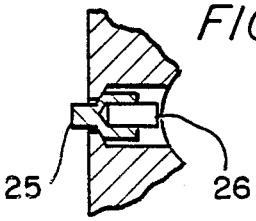

DOOR MAGNET IMPROVEMENT

This application is a continuation of application Ser. No. 07/069,992, filed July 6, 1987 now abandoned.

BACKGROUND OF THE INVENTION

A common method of holding a door in an open position is to use an electromagnet attached to an adjacent wall and an armature plate attached to the pull side of the door. As shown in FIGS. 1–4, the armature and the magnet are installed at the same distance from the door pivot point and come in contact when the door is opened to the maximum position. Hopefully, this occurs when the door is opened to 90° from the closed position, however, this can only happen when the combined depth of the mating magnet and armature assembly is equal to the distance from the pull face of the door to the wall as shown in FIG. 2. Additionally, the width of the door is another variable that influences the angle at which the door is held, as shown in FIG. 4.

Because of the fixed distance from the armature plate to the face of the door and the fixed distance from the pivot point of the door to the adjoining wall; and/or the different widths of the door; the user of the electromagnetic holder is at the mercy of the sum of these variables and must accept the resultant dictated degree of door opening at the hold open position.

There is, however, a single, albeit expensive and limited option to affect a more desirable degree of hold open position. The user may modify the door attachment base by specially ordering a thinner one to increase the angle of the door or by specially ordering spacers to increase the armature base to door face distance, thereby decreasing the angle of the door in its held open position.

SUMMARY OF THE INVENTION

It is the object of this invention to overcome the construction variables and the need to specially order non-stock parts as mentioned above by providing a field adjustable assembly that will selectively vary the distance from the face of the armature to the face of the door within a usable range that will yield an optimum degree of door opening.

It is a further object of this invention to provide a means to adjust the parallelism of the armature face to the electromagnet to accomplish maximum holding power.

These and other objects are obtained in a magnetic door holding assembly comprising: an armature having a face which coacts with a magnetic means in parallel relationship as a means of securing a door, a means attached to the armature for mounting the armature to a door face and for adjusting the distance between the door face and the armature face and a means for locking same; and a means for adjusting the parallelism of the face of the armature relative to a face of the magnetic means on contact, and a means for locking same.

BRIEF DESCRIPTION OF THE DRAWINGS

FIG. 1 shows a top view of a door, door jamb, wall magnet and armature in closed to open relationship.

FIG. 2 shows a top view of a door, door jamb, wall magnet and armature in a desired open relationship.

FIG. 3 depicts the open relationship where the door jamb extends too far from the wall showing the armature and magnet relationship.

FIG. 4 depicts the effect of a narrow door on the relationship of the armature and magnet.

FIG. 5 shows a plan view of an armature assembly according to the present invention.

FIG. 6 shows a right end or face view of an armature assembly according to the present invention.

FIG. 7 shows a detail cross section of a plunger utilized to rotationally secure the armature in a preferred position and assist in release of the door holder.

DESCRIPTION OF THE PREFERRED EMBODIMENT

FIG. 1 shows a typical door, door jamb and wall assembly generally designated by the reference numeral 1. The door 2 is of typical construction and may be made of wood, metal a combination thereof or other suitable material or composite. The door is mounted to a door jamb 3 by means of a hinge or pivot 4 which permits rotation of the door from a closed position within the door jamb to an open position in roughly parallel relationship with the wall 5 which is adjacent to the door jam. A known means for retaining the door in the open position is an electromagnet comprising an armature 6 and a magnet 7.

FIG. 2 shows the door in the open position in a preferred parallel relationship with the wall and having both the armature face 8 and the magnet face 9 in abutted coacting parallel relationship with a favorable offset distance D between the wall and door.

FIG. 3 shows the skew that results in the armature face and magnet face from a door jamb or pivot point too far removed from the adjacent wall, offset D.

FIG. 4 shows the additional skew resulting from a door that is narrower for a given offset D.

Referring now to FIGS. 5 and 6 according to the present invention it will be seen that a bracket base 10 contains a centrally located threaded hole 11 that transports the threaded adjustment screw 15. This threaded union permits the user to vary the offset distance D to achieve the required degree of door opening. When the adjusting screw is set by rotation to provide the optimum distance D, the installer tightens locknut 16 to secure the setting.

Bracket base 10 is further provided with holes 17 which permit the mounting of the bracket base to the door 2 by means of, for example, wood screws or similar fasteners (not shown). An access hole 12 is provided in the door to accept the adjustment screw 15.

An alternate method of locking adjustment screw 15 in bracket base 10 is to utilize a transverse locking screw (not shown) which is threaded into the bracket base and abuts and locks adjusting screw 15. This is an alternate to the locking nut 16 shown on FIG. 5.

The present invention incorporates a ball end 20 on the adjusting screw 15 and a spherical socket 21 in the mating swivel pad (armature) 8'. This permits the armature 8' to revolve 360° about its central point. An elongated cutout 22 adjacent to the spherical socket permits the swivel pad to rotate with respect to the centerline of adjusting screw 15. This combination of revolution and rotation of the armature assures that it will always be parallel with and in full contact with the face 9 of the wall mounted magnet 7 even when the magnet may be improperly installed and/or the door is held open at an angle substantially out of parallel with the adjacent wall as shown in FIGS. 3 and 4.

In the preferred embodiment shown, the swiveled armature may be locked in its required position with locking set screw 23. The locking screw is off center of the adjusting screw ball end as can be seen in both FIGS. 5 and 6. This off center location in two planes assures that the cone point of locking screw 23 tangentially strikes the ball 20 of adjusting screw 15. This tangential contact eliminates all movement between the ball end and mating socket in the armature and additionally, accomplishes this without penetrating and permanently deforming the ball as is usually done when set screws are used on center for securing assemblies. This desirable feature permits easy relocation of the armature plate if necessary.

In the preferred embodiment shown in FIG. 7, plunger 25 is urged outward by spring 26 to separate the armature from the magnet in the event that any residual magnetism remains to hold the door open after an electrical circuit to the magnet is open.

Having described my invention in terms of a preferred embodiment, numerous modifications may occur to one skilled in the art. I do not wish to be limited in the scope of my invention except by the following claims:

I claim:

1. A magnetic door holding assembly for securing a door in an open position against an adjacent wall with varying offset dimension comprising:

an armature having a planar face which coacts with a magnetic means in parallel relationship as a means for securing a door;

a variable set and lockable adjustment means attached to said armature for mounting said armature to a door surface and for selectively adjusting and retaining the set distance between said door surface and said armature face; and a means in contact with and coacting with said armature for adjusting and maintaining the parallelism of said armature face relative to a face of said magnetic means on contact to accommodate a varying offset dimension.

2. A magnetic door holding assembly according to claim 1 further comprising:

said face of said magnetic means being planar; and a means for securing said armature means in parallel face to face relationship with said magnetic means.

3. A magnetic door holding assembly according to claim 2 further comprising:

a means on side planar face of said armature for inducing separation of said face to face relationship upon dimunition of the force of said magnetic means.

4. A magnetic door holding assembly according to claim 1 wherein: said means for mounting and adjusting said armature further includes a ball joint captured in said armature.

5. A magnetic door holding assembly according to claim 4 wherein said captured ball joint comprises:

said armature has a ball socket formed therein for receiving a ball head of an adjusting screw extending from said door face.

6. A magnetic door holding assembly according to claim 5 wherein: said mounting and adjusting means comprises a ball headed adjusting screw mounted in a threaded base secured to a door whereby rotation of said screw results in extension or retraction of said adjusting screw; and said ball head is retained in said socket by means of an offset set screw disposed in said armature and contacting said ball head.

7. A magnetic door holding assembly according to claim 3 wherein: said means for inducing separation further comprises a spring loaded plunger contacting said ball head adjusting screw and disposed in a bore in said armature and projecting from the face of said armature.

8. A magnetic door holding assembly according to claim 7 wherein:

said spring loaded plunger further preloads said ball headed adjusting screw thereby stabilizing said ball joint by resisting rotation thereof during adjustment and prior to fixed retention.

9. A magnetic door holding assembly according to claim 1 wherein:

said magnetic means is mounted on a wall adjacent to a door; and said armature and mounting adjusting means is mounted on said door.

10. A magnetic door holding assembly according to claim 1 wherein:

said armature mounting and adjusting means permits 360° of rotation of said armature about the longitudinal axis of said adjusting screw and permits said armature to rotate with respect to the centerline of said adjusting screw.

11. A magnetic door holding assembly according to claim 6 wherein:

said set screw is offset from the longitudinal axis of the adjusting screw and offset from a transverse centerline axis of said ball head to eliminate set screw point contact on said ball head.

12. A magnetic holding assembly comprising:

an armature having a face which coacts with a magnetic means in parallel relationship as a means of securing a pivoting panel;

a means attached to said armature for mounting said armature to said pivoting panel and for adjusting the distance between said pivoting panel and said armature face;

a means positioned for adjusting and retaining the parallelism of said armature face relative to a face of said magnetic means on contact; and a means on said armature face for inducing separation of said armature and said magnetic means upon diminution of the force of said magnetic means.

* * * * *